US009653848B2

(12) United States Patent
Masubuchi et al.

(10) Patent No.: US 9,653,848 B2
(45) Date of Patent: May 16, 2017

(54) CONNECTOR

(71) Applicant: DDK Ltd., Tokyo (JP)

(72) Inventors: Tadashi Masubuchi, Tokyo (JP); Takuya Higeta, Tokyo (JP); Masayoshi Nemoto, Tokyo (JP)

(73) Assignee: DDK Ltd., Tokyo (JP)

( * ) Notice: Subject to any disclaimer, the term of this patent is extended or adjusted under 35 U.S.C. 154(b) by 0 days.

(21) Appl. No.: 15/006,024

(22) Filed: Jan. 25, 2016

(65) Prior Publication Data

US 2016/0156133 A1 Jun. 2, 2016

Related U.S. Application Data

(63) Continuation of application No. 13/871,967, filed on Apr. 26, 2013, now Pat. No. 9,276,342.

(30) Foreign Application Priority Data

Apr. 27, 2012 (JP) ..... 2012-102684
Apr. 5, 2013 (JP) ..... 2013-079574

(51) Int. Cl.
*H01R 12/77* (2011.01)
*H01R 13/6471* (2011.01)
*H01R 31/08* (2006.01)

(52) U.S. Cl.
CPC ..... *H01R 13/6471* (2013.01); *H01R 12/775* (2013.01); *H01R 31/08* (2013.01)

(58) Field of Classification Search
CPC ..... H01R 12/775; H01R 13/6471; H01R 23/6873; H01R 31/08
See application file for complete search history.

(56) References Cited

U.S. PATENT DOCUMENTS 8,702,451 B2 4/2014 Luo et al.
8,764,460 B2 7/2014 Smink et al.
2002/0132525 A1 9/2002 Tanaka
(Continued)

FOREIGN PATENT DOCUMENTS

CN 201425978 3/2010
CN 101960674 1/2011
(Continued)

OTHER PUBLICATIONS

Office Action for China Patent App No. 201310151269.5 dated Feb. 29, 2016, 15 pgs.
(Continued)

*Primary Examiner* — Briggitte R Hammond
(74) *Attorney, Agent, or Firm* — Procopio, Cory, Hargreaves & Savitch LLP

(57) ABSTRACT

A connector includes a housing and a plurality of signal contacts and a plurality of ground contacts. Each contact includes a contact portion that contacts an object, a connection portion mounted on a substrate, and a fixing portion located between the contact portion and the connection portion in the vicinity of the connection portion. The signal contact and the ground contact are aligned and held in the housing, and the fixing portion is fixed to the housing. When the plurality of signal contacts are arranged between the ground contacts, at least two of the ground contacts are coupled and connected integrally or by a separate component, the coupling and connection being made in a section of each ground contact between one end (leading end) of the contact portion and the fixing portion, so that high-frequency transmission characteristics are improved.

7 Claims, 7 Drawing Sheets

(56) References Cited

U.S. PATENT DOCUMENTS

| | | | |
|---|---|---|---|
| 2009/0221165 | A1 | 9/2009 | Buck et al. |
| 2011/0269346 | A1 | 11/2011 | Casher et al. |
| 2012/0108019 | A1 | 5/2012 | Hartmann |
| 2012/0108109 | A1 | 5/2012 | Zhang et al. |
| 2012/0282808 | A1 | 11/2012 | Luo et al. |
| 2012/0319089 | A1 | 12/2012 | Shin et al. |

FOREIGN PATENT DOCUMENTS

| | | | |
|---|---|---|---|
| CN | 202076606 | U | 12/2011 |
| JP | 04-108867 | | 9/1992 |
| JP | 61-227386 | | 10/1996 |
| JP | 2007141587 | A | 6/2007 |
| JP | 2012508958 | A | 4/2012 |
| JP | 2013-004517 | | 1/2013 |
| WO | 2009/111283 | | 9/2009 |

OTHER PUBLICATIONS

Office Action for CN App No. 201310151269.5 dated Oct. 25, 2016, 10 pgs.

Decision to Grant a Patent for JP App No. 2013-079574 dated Aug. 22, 2016, 6 pgs.

Office Action for JP App No. 2013-079574 dated Jun. 27, 2016, 7 pgs.

Rejection Decision dated Jan. 24, 2017 for corresponding Chinese Application No. 201310151269.5, 5 pages untranslated, 6 pages translated in English. (11 pages total) State Intellectual Property Office of China.

Office Action (Divisional) dated Mar. 27, 2017 for corresponding Japanese Application No. 2016-141057, 3 pages untranslated, 4 pages translated in English. (7 pages total) Japan Patent Office.

CONNECTOR

BACKGROUND

The present disclosure relates to a connector for use in electrical equipment and electronic equipment, such as hard disk drives (HDD), solid state drives (SSD), PCs, and servers. More particularly, the present disclosure relates to a structure in which ground contacts are coupled and connected together for improvement of high-frequency transmission characteristics.

Description of the Related Art

Such type of connector at least includes a housing and a plurality of contacts of two types: a plurality of signal contacts and a plurality of ground contacts. Each of the plurality of signal contacts and the plurality of ground contacts has a contact portion that contacts an object and a connection portion mounted on a substrate. In the housing, the signal contacts and the ground contacts are aligned and held. The connector can further include a power contact and a testing contact, as necessary. A total of 14 contacts consisting of eight of the signal contacts and six of the ground contacts are used. The structure is such that two of the signal contacts are arranged between the ground contacts. Of the 14 signal and ground contacts, seven include a section which is exposed on the housing and contact an object, and are partially not held on (held between) the housing. With this connector, signals are exchanged bi-directionally via two signal contacts, not via a single signal contact.

Conventional connectors with the above configuration that the applicant has previously proposed are, e.g., those disclosed in Patent Documents 1 and 2: JP Patent Appl. Publ. No. 61-227386 (Patent Document 1) discloses a connector in which a ground terminal plate is coupled by and connected to a contact tail. JP Utility Model Appl. Publ. No. 04-108867 (Patent Document 2) discloses a connector in which bare ground wires of a flat cable are directly connected to a plurality of ground terminals which are coupled by a ground bar.

Problems to be Solved

In recent years, there has been a customer need for improvement of high-frequency transmission characteristics. Specifically, the standard value has been changed from 4.5 GHz to 6 GHz, requiring improvement by about 30%. Such improvement of high-frequency transmission characteristics requires that the ground contacts be coupled and connected together. However, since the transmission characteristics vary with the coupling position between the ground contacts, an improvement in the transmission characteristics by 30% is difficult to achieve. In addition, the coupling can be difficult depending on the coupling position. It is also required to select a coupling and connecting means that is suitable for the holding structure of the contacts. The transmission characteristics are improved with the connector according to Patent Document 1. However, it is difficult to improve the transmission characteristics by about 30% since the connection portions are coupled together. Since the connector according to Patent Document 2 is designed such that a cable is connected to the connection portions, it is difficult to improve the transmission characteristics by about 30%.

SUMMARY

The present disclosure was made in view of the above-mentioned problems of the conventional art. It is an objective of the present disclosure to provide a connector having a structure that enables to readily couple and connect ground contacts and can improve high-frequency transmission characteristics.

Means for Solving the Problems

In the following will be given the gist of the present invention.

(1) The aforementioned objective of the present disclosure can be achieved by a connector including a housing and a plurality of contacts of two types: a plurality of signal contacts and a plurality of ground contacts. Each of the plurality of signal contacts and the plurality of ground contacts includes a contact portion that contacts an object, a connection portion mounted on a substrate, and a fixing portion located between the contact portion and the connection portion and in the vicinity of the connection portion. The signal contacts and the ground contacts are aligned and held in the housing, and the fixing portion is fixed to the housing. When the plurality of signal contacts are arranged between the ground contacts, at least two of the ground contacts are coupled and connected integrally or by a separate component, the coupling and connection being made in a section of each ground contact between one end (leading end) of the contact portion and the fixing portion, so that high-frequency transmission characteristics are improved.

(2) The connector according to (1) is such that the at least two of the ground contacts are coupled and connected integrally or by a separate component in a section of each ground contact that is in the vicinity of the contact portion.

(3) The connector according to (2) is such that the ground contacts are coupled and connected together within a range of 1 mm from a position at which the contact portion contacts an object.

(4) The connector according to any one of (1) to (3) is such that in the case of the integral coupling and connection, the coupling portion is formed by drawing or bending, and in the case of using the separate component, the coupling portion is formed by elastic contact of an elastic piece or by welding or fusion bonding.

(5) The connector according to any one of (1) to (4) is such that when the signal contacts and the ground contacts have a section exposed on the housing and are partially not held on (held between) the housing, the ground contacts are coupled and connected integrally by drawing or bending.

(6) The connector according to any one of (1) to (5) is such that a coupling structure between the ground contacts is selected according to the holding structure of the ground contacts.

(7) The connector according to any one of (1) to (6) is such that three ground contacts are coupled and connected together, and two sets of two of the signal contacts are separately arranged between the ground contacts.

Advantages of the Invention

As is apparent from the foregoing description, the following advantageous effects can be obtained with the connector according to the present disclosure. The connector of the present disclosure enables to readily couple and connect the ground contacts and to improve the high-frequency transmission characteristics by about 30% (in order, for example, to address the change of the frequency requirement from 4.5 GHz to 6 GHz), as compared with a connector of the conventional art, thereby satisfying the standard value.

(1) The connector according to the present disclosure includes a housing and a plurality of contacts of two kinds: a plurality of signal contacts and a plurality of ground contacts. Each of the plurality of signal contacts and the plurality of ground contacts includes a contact portion that contacts an object, a connection portion mounted on the substrate, and a fixing portion located between the contact portion and the connection portion and in the vicinity of the connection portion. The signal contacts and the ground contacts are aligned and held in the housing, and the fixing portion is fixed to the housing. When the plurality of signal contacts are arranged between the ground contacts, at least two of the ground contacts are coupled and connected integrally or by a separate component, the coupling and connection being made in a section of each ground contact between one end (leading end) of the contact portion and the fixing portion, so that high-frequency transmission characteristics are improved. In this way, the ground contacts can be readily coupled and connected together to improve the high-frequency transmission characteristics by about 30%, as compared with the conventional connector, thereby satisfying the standard value.

(2) At least two of the ground contacts are coupled and connected integrally or by a separate component in a section of each ground contact that is in the vicinity of the contact portion. In this way, the ground contacts can be readily coupled and connected together to improve the high-frequency transmission characteristics by 30%, as compared with the conventional connector, thereby satisfying the standard value.

(3) The ground contacts are coupled and connected together within a range of 1 mm from a position at which the contact portion contacts an object. In this way, the ground contacts can be readily coupled and connected together to improve the high-frequency transmission characteristics by 30%, as compared with the conventional connector, thereby satisfying the standard value.

(4) In the case of the integral coupling and connection, the coupling portion is formed by drawing or bending, and in the case of using the separate component, the coupling portion is formed by elastic contact of an elastic piece or by welding or fusion bonding. In this way, the coupling structure can be properly selected according to the structure of the connector, and the ground contacts can be readily coupled and connected together to improve the high-frequency transmission characteristics by 30%, as compared with the conventional connector, thereby satisfying the standard value.

(5) When the signal contacts and the ground contacts have a section exposed on the housing and are partially not held on (held between) the housing, the ground contacts are coupled and connected integrally by drawing or bending. In this way, the contacts, even if exposed, are not displaced outward so that the stable connection can be obtained, and the ground contacts can be readily coupled and connected together to improve the high-frequency transmission characteristics by 30%, as compared with the conventional connector, thereby satisfying the standard value.

(6) The coupling structure between the ground contacts is selected according to the holding structure of the ground contacts. In this way, the contacts, even if exposed, are not displaced outward so that stable connection can be obtained, and the ground contacts can be readily coupled and connected together to improve the high-frequency transmission characteristics by 30%, as compared with the conventional connector, thereby satisfying the standard value.

(7) Three ground contacts are coupled and connected together and two sets of two of the signal contacts are separately arranged between the ground contacts. In this way, the ground contacts can be readily coupled and connected together to improve the high-frequency transmission characteristics by 30%, as compared with the conventional connector, thereby satisfying the standard value.

DESCRIPTION OF THE PREFERRED EMBODIMENT

A feature of the present disclosure is a connector. The connector includes a housing and a plurality of contacts of two types: a plurality of signal contacts and a plurality of ground contacts. Each of the plurality of signal contacts and the plurality of ground contacts includes a contact portion that contacts an object, a connection portion mounted on a substrate, and a fixing portion located between the contact portion and the connection portion and in the vicinity of the connection portion. The signal contacts and the ground contacts are aligned and held in the housing, and the fixing portion is fixed to the housing. When the plurality of signal contacts are arranged between the ground contacts, at least two of the ground contacts are coupled and connected integrally or by a separate component, the coupling and connection being made in a section of each ground contact between one end (leading end) of the contact portion and the fixing portion, so that the high-frequency transmission characteristics are improved.

Specifically, at least two of the ground contacts are coupled and connected integrally or by a separate component, the coupling and connection being made in a section of each ground contact between one end (leading end) of the contact portion and the fixing portion, so that the high-frequency transmission characteristics are improved.

Figure 1:
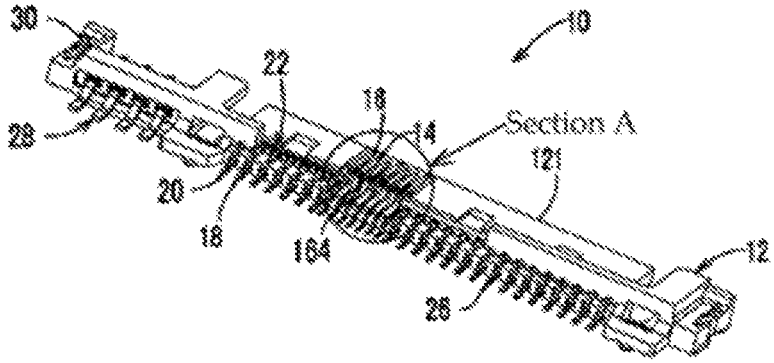
FIG. 1(A) is a perspective view of a connector 10 of the present disclosure, viewed from above in a direction in which a substrate is connected.
FIG. 1(B) is a perspective view of the connector 10 of the present disclosure turned upside down, viewed from above in a fitting direction.
FIG. 1(C) is a perspective view of the connector 10 of the present disclosure, viewed from above in a direction in which a substrate is connected, with the connector 10 being mounted on the substrate.
Figure 1:
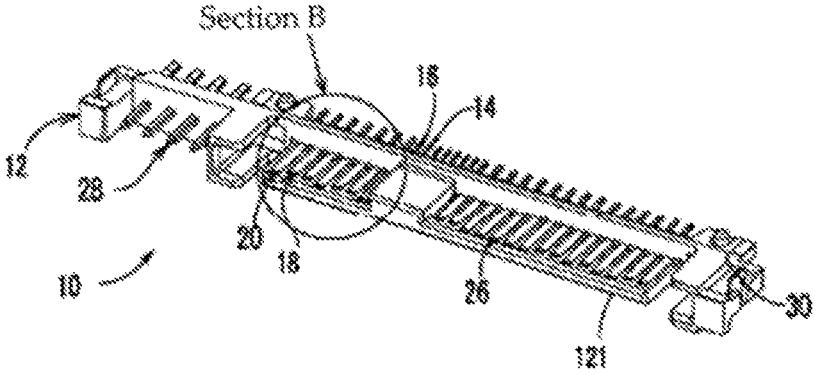
Figure 1:
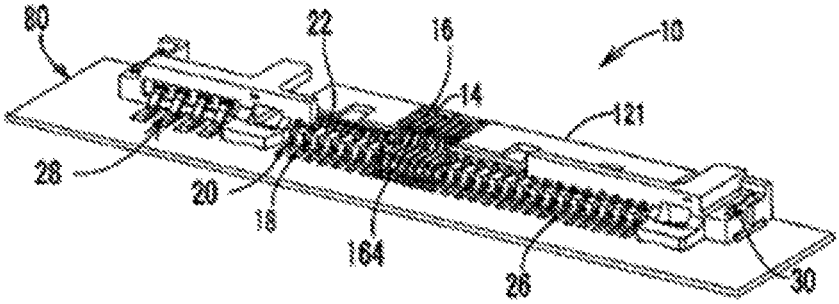
Figure 2:
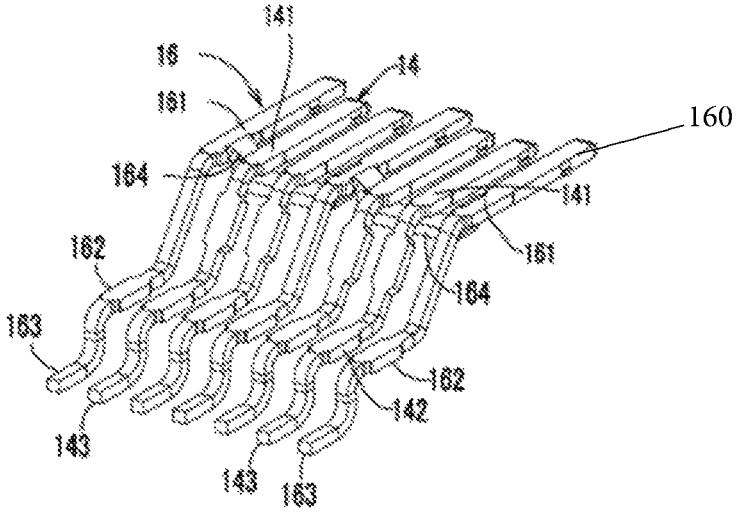
FIG. 2(A) is a perspective view of the four second signal contacts 14 and the three second ground contacts 16 situated in the circled area (Section A) of FIG. 1(A).
FIG. 2(B) is a perspective view of the four first signal contacts 18 and the three first ground contacts 20 situated in the circled area (Section B) of FIG. 1(B).
Figure 2:
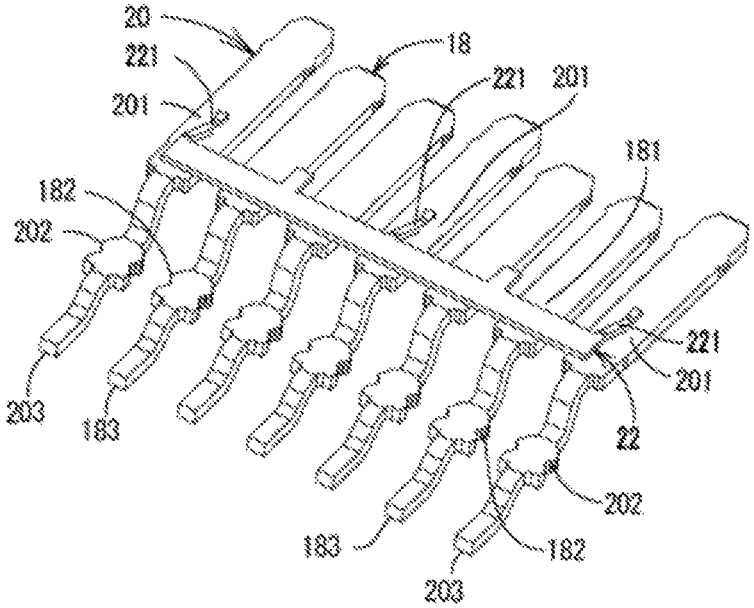
Figure 3:
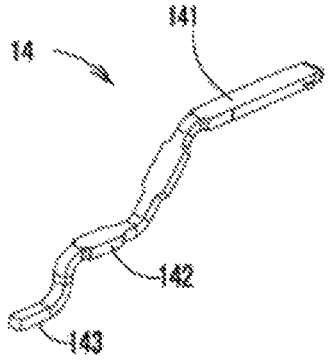
FIG. 3(A) is a perspective view of one of the second signal contacts 14 of the contacts of FIG. 2.
FIG. 3(B) is a perspective view of one of the second ground contacts 17 of the contacts of FIG. 6.
FIG. 3(C) is a perspective view of the three second ground contacts 16 illustrated in FIG. 2(A).
FIG. 3(D) is a perspective view of one of the first signal contacts 18 of the contacts of FIG. 2(B).
FIG. 3(E) is a perspective view of one of the first ground contacts 20 of the contacts of FIG. 2(B).
Figure 3:
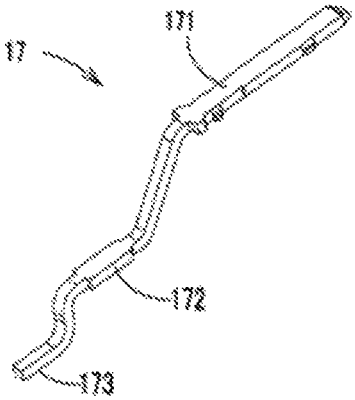
Figure 3:
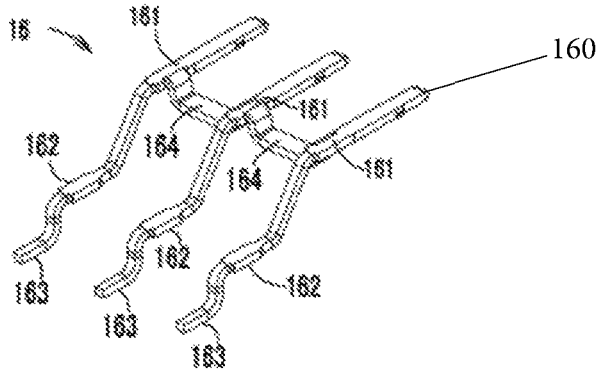
Figure 3:
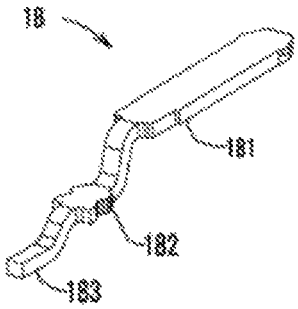
Figure 3:
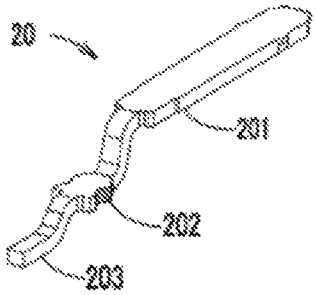
Figure 4:
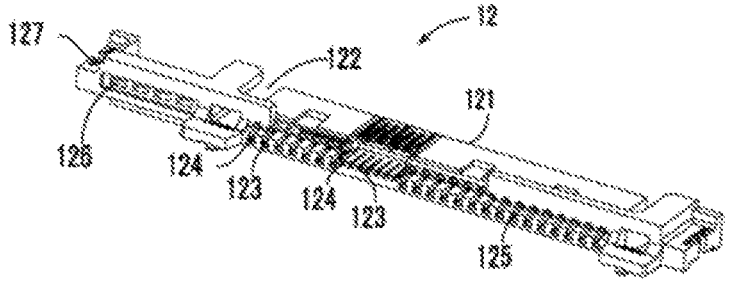
FIG. 4(A) is a perspective view of a housing constituting the connector of FIG. 1(A), viewed from above in a direction in which a substrate is connected.
FIG. 4(B) is a perspective view of the housing illustrated in FIG. 4(A) turned upside down, viewed from above in a fitting direction.
FIG. 4(C) is a longitudinal cross-sectional view of a contact insertion groove of a housing 12 into which the second ground contact 16 is inserted.
FIG. 4(D) is a longitudinal cross-sectional view of a contact insertion groove of the housing 12 into which the first ground contact 20 is inserted.
Figure 4:
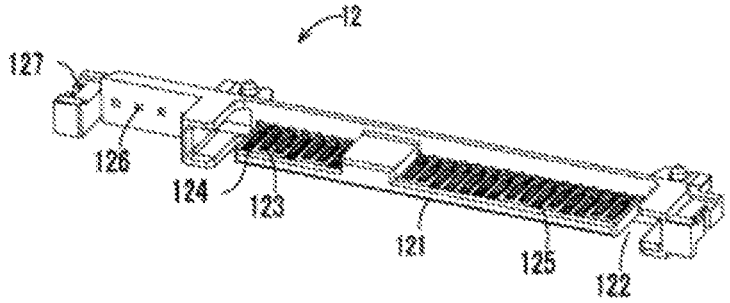
Figure 4:
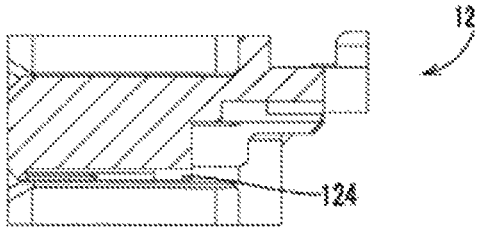
Figure 4:
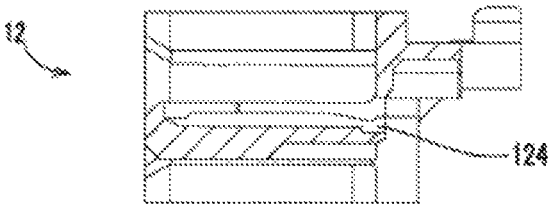
Figure 5:
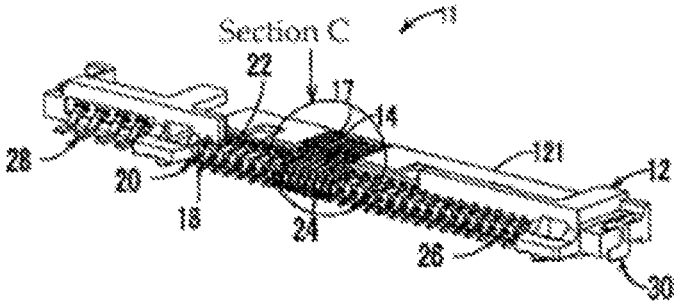
FIG. 5(A) is a perspective view of a connector 11, which is different from the connector 10 of FIG. 1, viewed from above in a direction in which a substrate is connected.
FIG. 5(B) is a perspective view of the connector 11 of FIG. 5(A) turned upside down, viewed from above in a fitting direction.
FIG. 5(C) is a perspective view of the connector 11 of FIG. 5(A) viewed from above in a direction in which a substrate is connected, with the connector 11 being mounted on the substrate.
Figure 5:
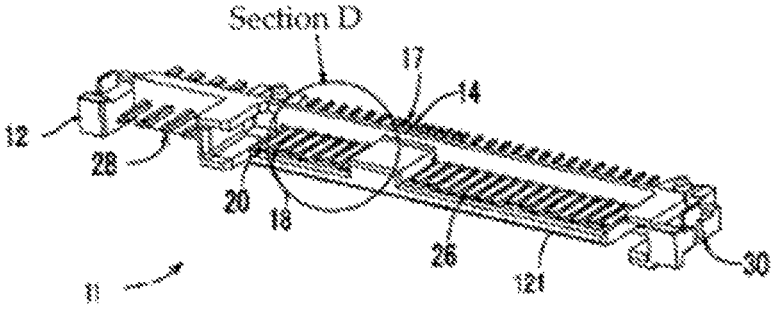
Figure 5:
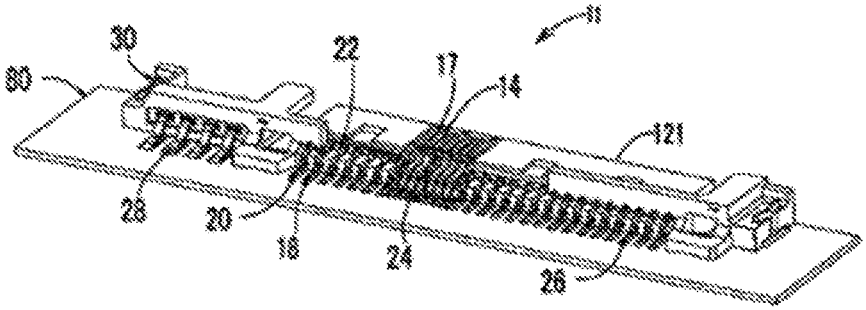
Figure 6:
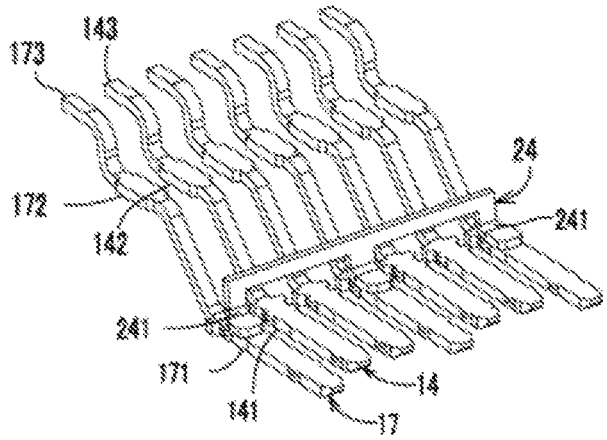
FIG. 6(A) is a perspective view of the four second signal contacts 14 and the three second ground contacts 17 situated in the circled area (Section C) of FIG. 5(A).
FIG. 6(B) is a perspective view of four of the first signal contacts 18 and three of the first ground contacts 20 situated in the circled area (Section D) of FIG. 5(B).
Figure 6:
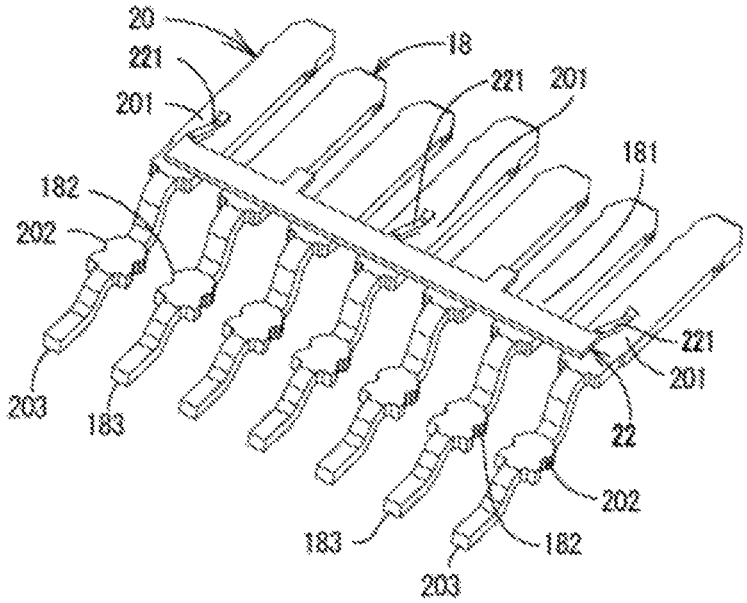
Figure 7:
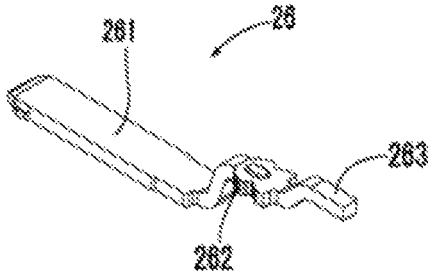
FIG. 7(A) is a perspective view of a power contact according to the present disclosure.
FIG. 7(B) is a perspective view of a testing contact according to the present disclosure.
FIG. 7(C) is a perspective view of a fixture according to the present disclosure.
Figure 7:
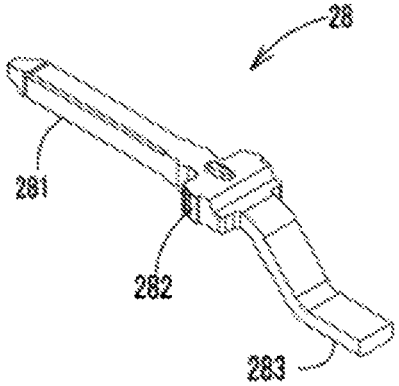
Figure 7:
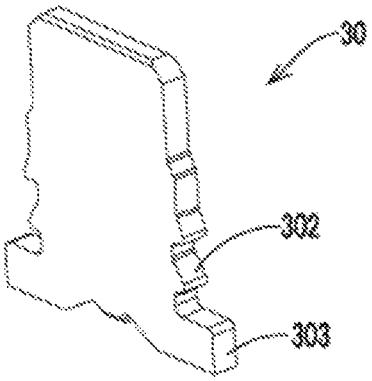

A connector 10 according to an embodiment of the present disclosure will be described with reference to FIGS. 1 to 7. FIG. 1(A) is a perspective view of the connector 10 of the present disclosure, viewed from above in a direction in which a substrate is connected. FIG. 1(B) is a perspective view of the connector 10 of the present disclosure turned upside down, viewed from above in a fitting direction. FIG. 1(C) is a perspective view of the connector 10 of the present disclosure, viewed from above in a direction in which a substrate is connected, with the connector 10 being mounted on the substrate. FIG. 2(A) is a perspective view of the four second signal contacts 14 and the three second ground contacts 16 situated in the circled area (Section A) of FIG. 1(A). FIG. 2(B) is a perspective view of the four first signal contacts 18 and the three first ground contacts 20 situated in the circled area (Section B) of FIG. 1(B). FIG. 3(A) is a perspective view of one of the second signal contacts 14 of the contacts of FIG. 2. FIG. 3(B) is a perspective view of one of the second ground contacts 17 of the contacts of FIG. 6. FIG. 3(C) is a perspective view of the three second ground contacts 16 illustrated in FIG. 2(A). FIG. 3(D) is a perspective view of one of the first signal contacts 18 of the contacts of FIG. 2(B). FIG. 3(E) is a perspective view of one of the first ground contacts 20 of the contacts of FIG. 2(B). FIG. 4(A) is a perspective view of a housing constituting the connector of FIG. 1(A), viewed from above in a direction in which a substrate is connected. FIG. 4(B) is a perspective view of the housing illustrated in FIG. 4(A) turned upside down, viewed from above in a fitting direction. FIG. 4(C) is a longitudinal cross-sectional view of a contact insertion groove of the housing 12 into which the second ground contact 16 is inserted. FIG. 4(D) is a longitudinal cross-sectional view of a contact insertion groove of the housing 12 into which the first ground contact 20 is inserted. FIG. 5(A) is a perspective view of a connector 11, which is different from the connector 10 of FIG. 1, viewed from above in a direction in which a substrate is connected. FIG. 5(B) is a perspective view of the connector 11 of FIG. 5(A) turned upside down, viewed from above in a fitting direction. FIG. 5(C) is a perspective view of the connector 11 of FIG. 5(A) viewed from above in a direction in which a substrate is connected, with the connector 11 being mounted on the substrate. FIG. 6(A) is a perspective view of the four second signal contacts 14 and the three second ground contacts 17 situated in the circled area (Section C) of FIG. 5(A). FIG. 6(B) is a perspective view of the four first signal contacts 18 and the three first ground contacts 20 situated in the circled area (Section D) of FIG. 5(B). FIG. 7(A) is a perspective view of a power contact according to the present disclosure. FIG. 7(B) is a perspective view of a testing contact according to the present disclosure. FIG. 7(C) is a perspective view of a fixture according to the present disclosure.

As shown in FIGS. 1(A) to 1(C), the connector 10 according to the present disclosure at least includes a housing 12, signal contacts 14, 18, and ground contacts 16, 20. The connector 10 can further include a power contact 26, a testing contact 28, and a fixture 30, as necessary. In the following will be given a description of a connector according an embodiment of the present disclosure which includes the power contact 26, the testing contact 28, and the fixture 30.

First, a substrate 80 used in the present embodiment will be described, followed by a description of constituent elements of the connector 10 of the present disclosure. The substrate 80 mainly includes a land and a pattern leading from the land to the circuit. The land is connected to connection portions 143, 163, 183, 203, 263, 283 of the contacts 14, 16, 18, 20, 26, 28 and to a connection portion 303 of the fixture 30. The fixture 30 is to increase the mounting strength of the connector 10. The substrate 80 further includes a hole or a groove into which a positioning boss is inserted.

Constituent elements of the connector 10 according to the present disclosure will be described. First, the contacts 14, 16, 18, 20, 26, 28 will be described. Each of the contacts 14, 16, 18, 20, 26, 28 is made of metal and manufactured by a publicly known pressing technique. Examples of the material of the contacts 14, 16, 18, 20, 26, 28, which is required to have springiness, conductivity, dimensional stability, etc., include brass, beryllium copper, and phosphor bronze. According to the present embodiment, the contacts 14, 16, 18, 20, 26, 28 are fixed to the housing 12 by press-fitting.

The signal contacts 14 and 18 are described with reference to FIG. 3. The types of of these signal contacts include: the second signal contact 14 for SAS and the first signal contact 18 for SATA. The second signal contact 14 is a secondary signal segment and the first signal contact 18 is a primary signal segment. The second signal contact 14 and the first signal contact 18 include respectively contact portions 141 and 181 that contact an object, fixing portions 142 and 182 fixed to the housing 12, and the connection portions 143 and 183 mounted on the substrate 80.

Both the contact portions 141 and 181 according to the present embodiment are properly designed in the form of a plate-shaped piece so as to conforms to the shape of an object, which facilitates contact with the object. The connection portions 143 and 183 according to the present embodiment are of a surface mount type (SMT), as shown in FIG. 1(C), but may also be of a DIP type. The fixing portions 142 and 182, which are fixed to the housing 12, are provided in the vicinity of the connection portions 143 and 183, respectively. The fixing portions 142 and 182 are press-fitted to the housing 12 and held thereon.

Next, the ground contacts 16 and 20 are described with reference to FIG. 3. The types of these contacts include: the second ground contact 16 for SAS and the first ground contact 20 for SATA. The second ground contact 16 is a secondary signal segment, and the first ground contact 20 is a primary signal segment. The second ground contact 16 and the first ground contact 20 include respectively contact portions 161 and 201 that contact an object, fixing portions 162 and 202 fixed to the housing 12, and connection portions 163 and 203 mounted on the substrate 80.

Both the contact portions 161 and 201 according to the present embodiment are properly designed in the form of a plate-shaped piece so as to conform to the shape of an object, which facilitates contact with the object. The connection portions 163 and 203 according to the present embodiment are of a surface mount type (SMT), as shown in FIG. 1(C), but may also be of a DIP type. The fixing portions 162 and 202, which are fixed to the housing 12, are provided in the vicinity of the connection portions 163 and 203, respectively. The fixing portions 162 and 202 are press-fitted to the housing 12 and held thereon.

The second signal contact 14 and the second ground contact 16, both of which are for SAS, are so arranged that sets of the two second signal contacts 14, 14 are separately arranged between the second ground contacts 16, 16. A total of seven contacts consisting of four second signal contacts 14 and three second ground contacts 16 are arranged. Similarly, the first signal contact 18 and the first ground contact 20, both of which are for SATA, are so arranged that two sets of the two first signal contacts 18, 18 are separately arranged between the first ground contacts 20, 20. A total of seven contacts consisting of four first signal contacts 18 and three first ground contacts 20 are arranged. The difference between the contacts 14 and 16 for SAS and the contacts 18 and 20 for SATA is that the exposed sides of the contact portions 141 and 161 of the contacts 14 and 16 and the exposed sides of the contact portions 181 and 201 of the contacts 18 and 20 face opposite vertical directions.

At least two of the second ground contacts 16 and two of the first ground contacts 20 are coupled and connected integrally or by a separate component. In the present embodiment, all of the three ground contacts are coupled and connected together. The connector 10 is such that the second ground contacts 16 are coupled and connected integrally as shown in FIG. 2(A) and FIG. 3(C), and the first ground contacts 20 are coupled and connected by a separate component as shown in FIG. 2(B). The method of coupling and connecting is properly designed and selected in consideration of the structure of the housing 12, connection stability, workability, dimensional stability, strength etc. FIG. 4(C) is a longitudinal cross-sectional view of the contact insertion groove of the housing 12 into which the second ground contact 16 is inserted, and FIG. 4(D) is a longitudinal cross-sectional view of the contact insertion groove of the housing 12 into which the first ground contact 20 is inserted. When the housing 12 is so structured that the contacts can be held from above and below as shown in FIG. 4(D), the contacts may be coupled and connected by a spring piece. However, when an insulator is disposed only on one side as shown in FIG. 4(C), the contacts are preferably coupled and connected integrally or by a separate component, not by a spring piece.

The second ground contacts 16 are coupled and connected together in a section of each second ground contact 16 between one end (leading end 160) of the contact portion 161 and the fixing portion 162. In consideration of the efficiency of improvement of the high-frequency transmission characteristics, the second ground contacts 16 are preferably coupled in a section of each ground contact 16 that is in the vicinity of the contact portion 161. In the present embodiment, sections in the vicinity of the contact portions 161 are integrally coupled and connected by a coupling portion 164, which is formed by drawing or bending. In the present embodiment, the coupling portion 164 is formed by drawing. The coupling portion 164 is so formed as to accommodate two second signal contacts 14. In consideration of the high-frequency transmission characteristics, the second ground contacts 16 are coupled and connected by the coupling portion 164 preferably within a range of 1 mm from a position at which the contact portion 161 contacts an object.

When the first ground contacts 20 are coupled and connected by a separate component, the first ground contacts 20 are coupled in a section of each first ground contact 20 that is in the vicinity of the contact portion 201. This coupling is made by a coupling member 22 with a plate-shaped portion, and the coupling member 22 includes a bent elastic piece 221. The elastic piece 221 is provided at a position corresponding to the first ground contact 20. The shape and size of the elastic piece 221 are properly designed in consideration of connection stability, dimensional stability, workability, strength etc. In consideration of the high-frequency transmission characteristics, the first ground contacts 20 are coupled and connected by the elastic piece 221 preferably within a range of 1 mm from a position at which the contact portion 201 contacts an object.

Now, another connector 11 is described solely in terms of the difference from the connector 10. The difference lies in the method of coupling and connecting the second ground contacts 17. This coupling and connecting method is performed using a separate component as shown in FIG. 6(A). The separate component is a coupler 24 with a plate-shaped portion, and the coupler 24 includes a coupling piece 241 formed roughly in an L-shape. The second ground contacts 17 are coupled by welding the coupling piece 241 to sections of the contact portions 171, each of which is in the vicinity of the contact portion 171. The method of coupling the coupling piece 241 to the second ground contacts 17 is properly designed in consideration of stable connection, joint strength, workability, etc. Welding is employed in the present embodiment; however, joining by means of fusion bonding, swaging, or electrically conductive adhesive may be employed. In consideration of the high-frequency transmission characteristics, the second ground contacts 17 are coupled and connected by the coupling piece 241 of the coupler 24 preferably within a range of 1 mm from a position at which the contact portion 171 contacts an object.

As shown in FIG. 7(A), the power contact 26 at least includes a contact portion 261 that contacts an object, a fixing portion 262 fixed to the housing 12, and a connection portion 263 mounted on the substrate 80. The power contact 26 is to supply a current of 1.5 A and is formed roughly in the form of a crank.

The contact portion 261 according to the present embodiment is properly designed in the form of a plate-shaped piece so as to conform to the shape of an object, which facilitates contact with the object. The connection portion 263 according to the present embodiment is of a surface mount type (SMT) as shown in FIG. 1(C), but may also be of a DIP type.

The fixing portion 262, which is fixed to the housing 12, is provided in the vicinity of the connection portion 263. The fixing portion 262 is press-fitted to the housing 12 and held thereon.

As shown in FIG. 7(B), the testing contact 28 at least includes a contact portion 281 that contacts an object, a fixing portion 282 fixed to the housing 12, and a connection portion 283 mounted on the substrate 80. The testing contact 28 is to test an HDD or the like and is formed roughly in the form of a crank.

The contact portion 281 according to the present embodiment is properly designed in the form of a bar so as to conform to the shape of an object, which facilitates contact with the object. The connection portion 283 according to the present embodiment is of a surface mount type (SMT) as shown in FIG. 1(C), but may also be of a DIP type. The fixing portion 282, which is fixed to the housing 12, is provided in the vicinity of the connection portion 283. The fixing portion 282 is press-fitted to the housing 12 and held thereon.

Next, the housing 12 is described. The housing 12 is made of electrically insulating plastic and manufactured by a publicly known injection forming technique. The material of the housing 12 is properly selected in consideration of dimensional stability, workability, cost, etc., and examples thereof typically include polybutylene terephthalate (PBT), polyamides (66PA, 46PA), liquid crystal polymers (LCP), polycarbonates (PC), and synthetic materials thereof. The housing 12 is provided with a fitting opening 122 into which an object is inserted and a fitting portion 121 which is inserted into the object (see FIGS. 4(A) and 4(B)). The fitting opening 122 may be formed in any shape as long as the object can be inserted thereinto, and is properly designed so as to conform to the shape of the object. The fitting portion 121 may be formed in any shape as long as it can be inserted into the object, and is properly designed so as to conform to the shape of the object. Within the fitting portion 121 are held and aligned the second signal contact 14, the second ground contact 16, 17, the first signal contact 18, the first ground contact 20, and the power contact 26.

The housing 12 is provided with an insertion hole 123 into which the second signal contact 14 and the first signal contact 18 are inserted. The housing 12 is provided with an insertion groove 124 into which the second ground contact 16 and the first ground contact 20 are inserted. The housing 12 is provided with an insertion hole 125 into which the power contact 26 is inserted. The housing 12 is provided with a holding hole 126 into which the testing contact 28 is inserted. The housing 12 is provided with a mounting hole 127 in which the fixture 30 is held. These contacts are fixed by press-fitting, engagement (lance), fusion bonding, etc. In the present embodiment, the contacts are fixed by press-fitting.

In the present embodiment, the housing is provided with two positioning bosses (not shown) on the surface on which the substrate 80 is mounted. The bosses may be provided at any position as long as they can be used for positioning of the housing on the substrate 80, and are properly designed in consideration of strength, miniaturization or footprint of the connector, workability, etc.

Next, the fixture 30 is described with reference to FIG. 7. The fixture 30 is made of metal and manufactured by a publicly known pressing technique. Examples of the material of the fixture 30, which is required to have springiness, conductivity, etc., include brass, beryllium copper, and phosphor bronze. In the present embodiment, the fixture 30 is fixed to the mounting hole 127 of the housing 12 by press-fitting.

The fixture 30 is to increase the mounting strength of the connector, and the size and shape thereof are properly designed in consideration of mounting strength, dimensional stability, workability, strength, etc.

INDUSTRIAL APPLICABILITY

The present disclosure relates to a connector for use in electrical equipment and electronic equipment, such as hard disk drives (HDD), solid state drives (SSD), PCs, and servers. More particularly, the present disclosure relates to a structure in which ground contacts are coupled and connected together for improvement of high-frequency transmission characteristics.

DESCRIPTION OF REFERENCE NUMERALS

10, 11 connector
12 housing
121 fitting portion
122 fitting opening
123 insertion hole
124 insertion groove
125 insertion hole
126 holding hole
127 mounting hole
14 second signal contact
141 contact portion
142 fixing portion
143 connection portion
16, 17 second ground contact
161, 171 contact portion
162, 172 fixing portion
163, 173 connection portion
164 coupling portion
18 first signal contact
181 contact portion
182 fixing portion
183 connection portion
20 first ground contact
201 contact portion
202 fixing portion
203 connection portion
22 coupling member
221 elastic piece
24 coupler
241 coupling piece
26 power contact
261 contact portion
262 fixing portion
263 connection portion
28 testing contact
281 contact portion
282 fixing portion
283 connection portion
30 fixture
302 fixing portion
303 connection portion
80 substrate

What is claimed is:

1. A connector, comprising:

a plurality of contacts of two types, the plurality of contacts of two types being a plurality of signal contacts and a plurality of ground contacts, each contact including, a contact portion that contacts an object, a connection portion mounted on a substrate, and a fixing portion located between the contact portion and the connection portion and in a vicinity of the connection portion; and a housing, wherein the signal contact and the ground contact are aligned and held in the housing with the fixing portion being press-fitted to the housing, wherein the contact portion of each contact has a leading end and an end that is proximal to the fixing portion as compared to the leading end, and when the plurality of signal contacts are arranged between the ground contacts, at least two of the ground contacts are coupled and connected by a separate component at a section of each ground contact between the leading end of the contact portion and the fixing portion, so that high-frequency transmission characteristics are improved;

the connection portion, fixing portion, and contact portion extend in a stepwise shape;

at least the contact portion is located so as to be substantially parallel to the fixing portion; and each of the connection portion, the fixing portion and the contact portion are arranged to extend in a same virtual plane.

2. The connector according to claim 1, wherein the at least two ground contacts are coupled and connected by the separate component at a section of each ground contact that is in a vicinity of the contact portion.

3. The connector according to claim 2, wherein the ground contacts are coupled and connected within a range of 1 mm from a position at which the contact portion contacts an object.

4. The connector according to claim 1, wherein coupling and connection are achieved by one of: elastic contact by an elastic piece, welding, and fusion bonding.

5. The connector according to claim 1, wherein three ground contacts are coupled and connected together and two sets of two of the signal contacts are arranged between the ground contacts.

6. The connector according to claim 1, wherein the separate component is one of a coupling member and a coupler.

7. The connector according to claim 1, wherein the contact portion comprises a contact surface and a non-contact surface opposite to the contact surface, wherein the contact portion is arranged outside the housing and the contact surface is directed outward of the housing; and/or the contact portion is arranged inside the housing and the contact surface is directed inward of the housing; and the separate component is located on the non-contact surface side of the contact portion.

* * * * *